US010667569B2

(12) United States Patent
Fay

(10) Patent No.: US 10,667,569 B2
(45) Date of Patent: Jun. 2, 2020

(54) GARMENT WITH POCKET SUPPORT SYSTEM

(71) Applicant: LOWEN & SONS, LLC, Meridian, ID (US)

(72) Inventor: Lorelei Fay, Meridian, ID (US)

( * ) Notice: Subject to any disclaimer, the term of this patent is extended or adjusted under 35 U.S.C. 154(b) by 638 days.

(21) Appl. No.: 14/746,622

(22) Filed: Jun. 22, 2015

(65) Prior Publication Data

US 2015/0366280 A1 Dec. 24, 2015

Related U.S. Application Data

(60) Provisional application No. 62/015,150, filed on Jun. 20, 2014.

(51) Int. Cl.

| | |
|---|---|
| ***A41D 27/20*** | (2006.01) |
| ***A41C 1/14*** | (2006.01) |
| ***F41C 33/04*** | (2006.01) |
| ***A41F 9/00*** | (2006.01) |
| ***A41D 27/06*** | (2006.01) |

(52) U.S. Cl.

CPC ..... *A41D 27/205* (2013.01); *A41C 1/14* (2013.01); *F41C 33/046* (2013.01); *F41C 33/048* (2013.01); *A41D 27/06* (2013.01); *A41D 2300/20* (2013.01); *A41D 2400/48* (2013.01); *A41F 9/002* (2013.01)

(58) Field of Classification Search

CPC .. A41D 27/205; A41D 27/06; A41D 2400/48; A41D 2300/20; F41C 33/046; F41C 33/048; A41F 9/002; A41C 1/14

USPC ..... 2/311, 312; 450/143, 150

See application file for complete search history.

(56) References Cited

U.S. PATENT DOCUMENTS

| | | | | | |
|---|---|---|---|---|---|
| 2,181,689 | A | * | 11/1939 | Bell | A61F 5/028 2/44 |
| 4,175,553 | A | * | 11/1979 | Rosenberg | A61F 5/028 2/44 |
| 4,475,543 | A | * | 10/1984 | Brooks | A61L 15/07 602/19 |
| 4,527,566 | A | * | 7/1985 | Abare | A61F 7/02 601/15 |
| 4,586,506 | A | * | 5/1986 | Nangle | A61F 7/02 128/DIG. 15 |
| 4,676,247 | A | * | 6/1987 | Van Cleve | A61F 7/02 607/112 |
| 5,591,122 | A | * | 1/1997 | Yewer, Jr. | A61F 5/028 128/100.1 |
| 5,984,885 | A | * | 11/1999 | Gaylord, Jr. | A61F 5/028 128/96.1 |

(Continued)

*Primary Examiner* — Jameson D Collier
*Assistant Examiner* — Jocelyn Bravo
(74) *Attorney, Agent, or Firm* — Shaver & Swanson, LLP; Scott D. Swanson

(57) ABSTRACT

What is disclosed is a holster or pocket in a garment that is supported by a boning material. The garment is typically a waistband, girdle or corset made of elastic, spandex, nylon, polyester, cotton, Lycra, lace, stretchable or compression material. It is a garment that can be worn anywhere on one's torso, including extremities and can include the thighs, derriere and abdomen up to the arms and shoulders and include the front of the chest. The boning material resides between the outside area of the holster or pocket to provide the support necessary to keep the garment or holster material from sagging.

17 Claims, 4 Drawing Sheets

(56) References Cited

U.S. PATENT DOCUMENTS

| | | | | |
|---|---|---|---|---|
| 6,098,558 | A * | 8/2000 | Baird | B25F 5/029 112/413 |
| 6,137,675 | A * | 10/2000 | Perkins | G06F 1/163 128/876 |
| 6,585,673 | B1 * | 7/2003 | Bass | A61F 7/02 128/845 |
| 6,910,578 | B2 * | 6/2005 | Stern | B25H 3/003 206/350 |
| 2009/0292230 | A1 * | 11/2009 | Anquetil | A61F 5/028 602/19 |
| 2012/0255098 | A1 * | 10/2012 | Leyva | A61M 35/00 2/69 |

* cited by examiner

GARMENT WITH POCKET SUPPORT SYSTEM

PRIORITY/CROSS-REFERENCE TO RELATED APPLICATIONS

This application claims the benefit of U.S. Provisional Application No. 62/015,150, filed Jun. 20, 2014 the disclosure of which is incorporated by reference.

TECHNICAL FIELD

The presently disclosed technology relates to clothing and clothing accessories having pockets attached to or as a part of the clothing or clothing accessory.

BACKGROUND

The concept of concealing a firearm or other device, such as a wallet, cell phone, or passport on a person has been approached in many ways. One such way is to hold the firearm next to the body by means of an elastic waistband. This waistband has a pocket or holster type feature which holds the firearm in the waistband. This concept works with marginal results and constant repositioning of waistband is needed as the firearm or other object causes the elastic waistband to sag over a period of time when worn. It is also not ideal as no support is given to hold the firearm or other object in place as the body moves when the object is worn. This is particularly the case when a large frame firearm or other large or heavy object is desired to be carried. It should also be noted that this concept is not limited to holding around the waist only, but is included in ankle, arm or other extremity wrapping band designed to hold or holster either a firearm or device. In addition, it is not limiting to being concealed underneath clothing, but can reside exposed outside of clothing.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a garment or clothing accessory having an improved support pocket. The clothing garment has two lengths of rigid boning affixed to said garment, typically within small channels or pockets sewn into or otherwise attached to the garment. These boning pockets typically are taught on the clothing such that the two lengths of boning provide support or rigidity to the garment. The garment generally has a first length of boning and a second length of boning that are spaced apart such that a length of material, such as an elastic or cotton material, is stretched between the lengths of boning. The boning can be constructed out of a variety of rigid materials including, for example, nylon, polyester, or a metal.

The length of material is generally attached to the garment either at or proximate to the boning. The pockets in which the boning is located, can be attached directly to the boning. The boning can be positioned in a parallel orientation or in an angled orientation to create a pocket of uniform width or with a tapering width. In a preferred embodiment the pocket is generally in an open ended V-shape such that a handgun can be positioned in the firearm with the muzzle of the firearm protruding from the narrow opening of the V-shaped pocket and with the butt of the firearm protruding from the wider portion of the pocket. In a further preferred embodiment the garment can include a retaining mechanism, such as a cinch strap that is attached to the garment, loops over the butt of the firearm, and attaches to the material on the face of the pocket to retain the firearm. This retaining mechanism can be configured to be releasably attached to the garment, the pocket, or to both the garment and the pocket.

The garment can be made of a variety of materials, including elastic materials, neoprene, and/or lace materials. The garment can constitute a wide variety of garments, including, but not limited to, belly bands, arm bands, belts, and girdles.

In a preferred embodiment the pocket is constructed such that the pocket is sewn to the garment in a v-shape sewn between two generally parallel boning lengths. The boning lengths provide rigidity and support to the garment, thus providing additional support to the garment for when the garment is supporting an object such as a handgun. The garment can be constructed with one or more U-shaped pockets or V-shaped pockets, preferably depending on the garment's intended purpose.

Still other features and advantages of the presently disclosed and claimed inventive concept(s) will become readily apparent to those skilled in this art from the following detailed description of preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE PREFERRED EMBODIMENTS

Figure 1:
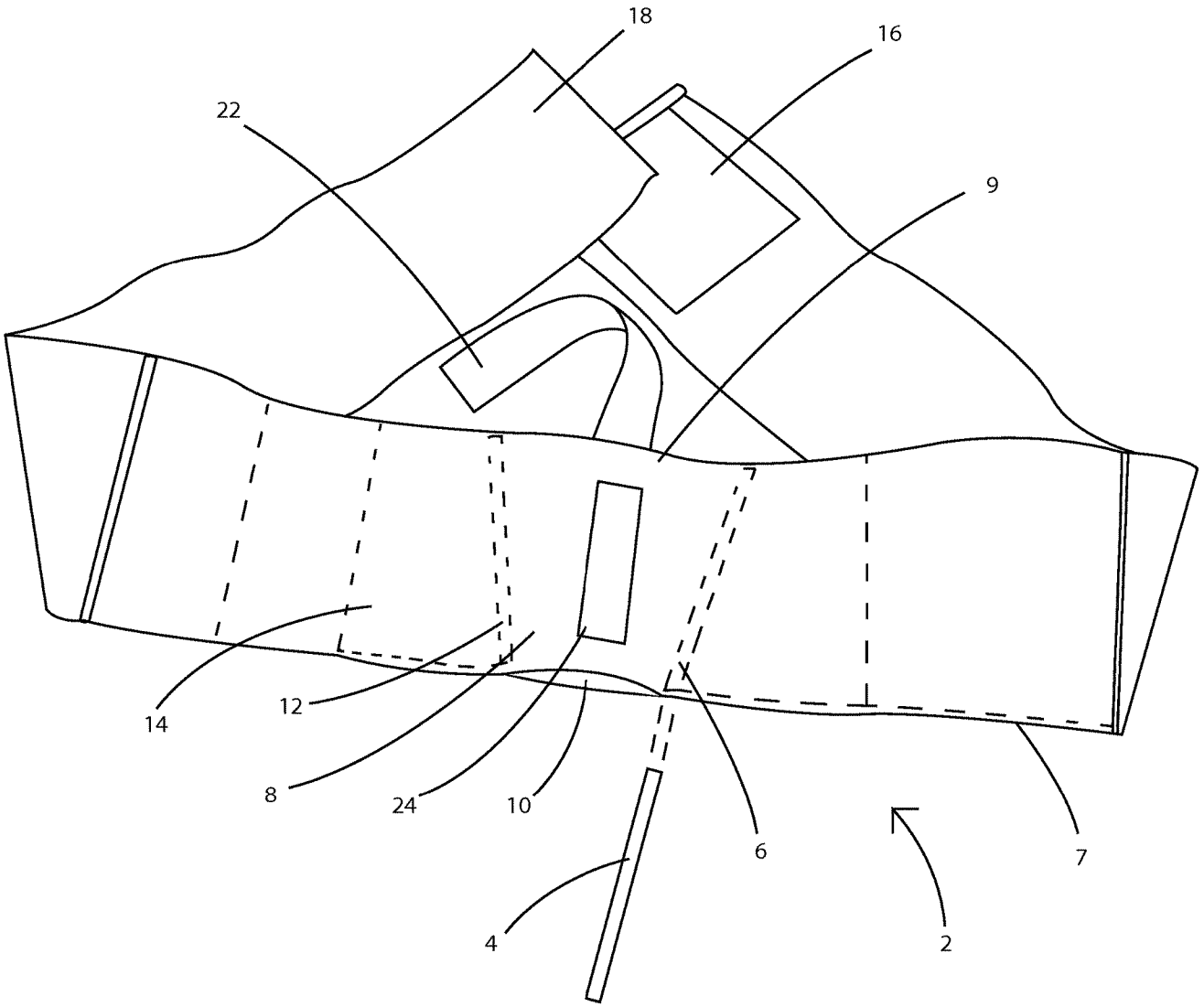
FIG. 1 is a front view of an embodiment of a garment band having a V-shaped holster supported by boning and retaining mechanism and a plurality of pockets.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

A novel concept to address the issue of a firearm or other device within an elastic waistband (or other band) from sagging is to incorporate a stiffener structure on the sides of the pocket or holster area. The elastic waistband can also be known as a girdle or corset. The elastic waistband can also reside around the waist only or be a body girdle or body corset. The main and novel disclosure is to add a stiffener to such a waistband, girdle, corset, body girdle or body corset to support a firearm or device in a holster or pocket within the worn apparatus. The holster or pocket in a preferred embodiment made of common elastic band material to assist in holding the firearm or device close to the torso.

The stiffener used in this disclosure is also known to those within the fabric industry as 'boning'. The boning or bones reside alongside the holster area in a vertical position to how the firearm or other device is held in place (such that the barrel of the firearm is generally parallel to the length of the bones). The bones can be made of materials such as Plastic, German Plastic, Hoop Steel, Spring Steel, Spiral Steel, Galvanized wire, Nylon, Polyester, Polyester Webbing or other preferably non corrosive, thin, flexible but ridged material. In specific detail, in a preferred embodiment the bones structure used in a current product for this disclosure is made of nylon. The bones structure is also commonly wrapped with a covering material or edging cotton wrap, which hides the bones from being seen or exposed. Any material that is rigid yet flexible or consistent with the purpose of supporting the item in the pocket so it does not sag can be used.

In a preferred embodiment, the boning structure resides in a generally vertical position to the holster area of the elastic waistband. Preferably, the boning is positioned to within approximately 25 mm of the either vertical edges of the holster area. More specifically, the boning structures are positioned within 10 mm of either vertical edges of the holster area. The structure is also not limited to being exactly alongside the holster vertical edges. In a preferred embodiment the length of the bones material is approximately the same length of the holster or width of the elastic waistband itself. Alternatively, the pocket and/or holster can be constructed as a pocket or holster positioned on a larger garment, for example a shirt, a pair of pants, or a sweatshirt. The boning provides enhanced support to the holster or pocket and provides for increased weight capability and/or improved carryability of the object within the holster. It is desired to have the bones material to be as long as the holster is tall to give maximum support to the firearm or device being held, but is not limited to being shorter. The preferred design is to have the bones be the same length as the waistband is tall/wide. In the case of a body girdle or body corset, the bones will be as long as the holster or pocket is tall. It is desired to have the holster or pocket not be wider than 150 mm in a preferred embodiment to give proper support to a firearm or device being carried. More specifically, the holster or pocket is not wider than 120 mm apart in a preferred embodiment. It should not be limiting to the width of the holster or pocket, but to those common with the clothing manufacturing, the bones need to reside alongside the holster or pocket designed area of the garment.

As mentioned, the bones' structure is made of the materials listed above. Using the nylon bones material as an example, the width of the bone is 3 mm and is 1.5 mm thick. This is not limited to only these dimensions and can be as wide as approximately 25 mm to as narrow as approximately 1 mm, depending on the material chosen. This is also not limited to only the thickness listed, but can be a thick as 3 mm to as thin as 0.25 mm. These thicknesses and widths are in a preferred embodiment are selected based on the bones material used or the bones are selected based on the thickness and width of the material needed to support a selected gun. Two or more support bones or boning can be used to support the pocket or holster to eliminate sagging on either side of the holster or pocket.

The holster or pocket to which a firearm or other device is to be held on the torso, is made of an elastic band or other stretchable material in a preferred embodiment. The holster or pocket is sewn on the waistband, girdle or corset (or other elastic band) in a manner which structurally resides within the bones location. Thus the bones support the elastic or other stretchable holster material and prevent the firearm or other device from sagging within the holster or pocket. The holster or pocket is also sewn in a fashion which has a top side that is more open then the bottom. This is achieved by sewing a V pattern into the holster or pocket which assists in holding the firearm or other device slightly above the holster area or pocket area to allow for quick access/reach/grabbing by the hand. The elastic band allows for a holding or tension support of the firearm between the bones region. Preferably, the elastic is a one way stretch but is not limited to one way and may be 2 way, 3 way, or 4 way stretch. Preferably the V-shape of the holster or pocket has an opening at the bottom to allow for the muzzle of the gun to protrude from the pocket. This will provide a more secure fit to hold a firearm or other device in place.

The waistband, girdle, or corset material in a preferred embodiment is to be made of at least one material selected from the group of elastic, lace, nylon and spandex with cotton. It should also be noted that the waistband, girdle or corset is not limited to these materials and can include Lycra, polyester, or any other material that contains stretching properties. The waistband can be comprised of any color or combination of colors.

In an exemplary embodiment the elastic is made from Ebay item "9" Corset Elastic Tan" that is cut it in half to make (2) 4.5" pieces. This is a two-way stretch elastic sold by Caspers Trading Post—North Smithfield, R.I., and is currently Ebay Item no. 321375335425.

Alternatively, the elastic material is 4.5" Black Elastic 2 way stretch, sold by Fabric Plenty 5 star discounts—Ridgewood, N.Y., currently Ebay No. 310406726480. An additional elastic material that is considered as a potential material consists of 70% polyester and 30% rubber. The elastic pouch material is not limited to elastic and be comprised of any stretchable material as described in the garment material description.

The waistband closure of the waistband, girdle or corset to fasten around the body is preferred to be made of Velcro to allow for a any given waist size and is adjustable based upon the amount of Velcro applied. It should be noted that the closure is not limited to Velcro, but can also be of snaps, buttons, draw string, string or belt with grommets, hook and eye, buckle, or a multitude of combined fasteners.

FIG. 1 depicts a girdle or belt 2 having a pocket 8 located on the girdle or belt. The pocket is in an open-ended V-shape that is thought to be preferable for supporting a handgun. The handgun is preferably placed into the pocket through top opening 9 with the butt of the gun located at the opening 9 and the muzzle or barrel of the handgun protruding from opening 10. Boning 4 is located within boning pocket 6 to secure the boning to the garment. Dotted lines generally illustrate sewing lines in the garment. The garment is supported by two lengths of boning 6, 12 (boning 6 is shown in an exploded view). The holster pocket includes retaining mechanism 22 which attaches in a preferred embodiment via hook and loop fasteners at attachment point 24 located on the pocket. The retaining mechanism can be positioned over a handgun or similar object and affixed to the pocket aide in retaining the handgun or other object within the pocket. Additional pockets 7, 14 can be located on the garment and can be further supported by additional boning. The garment as depicted can be formed as an endless loop by attaching the ends of the garment 16, 18 around a user's waist, arm, or similar appendage.

Figure 2:
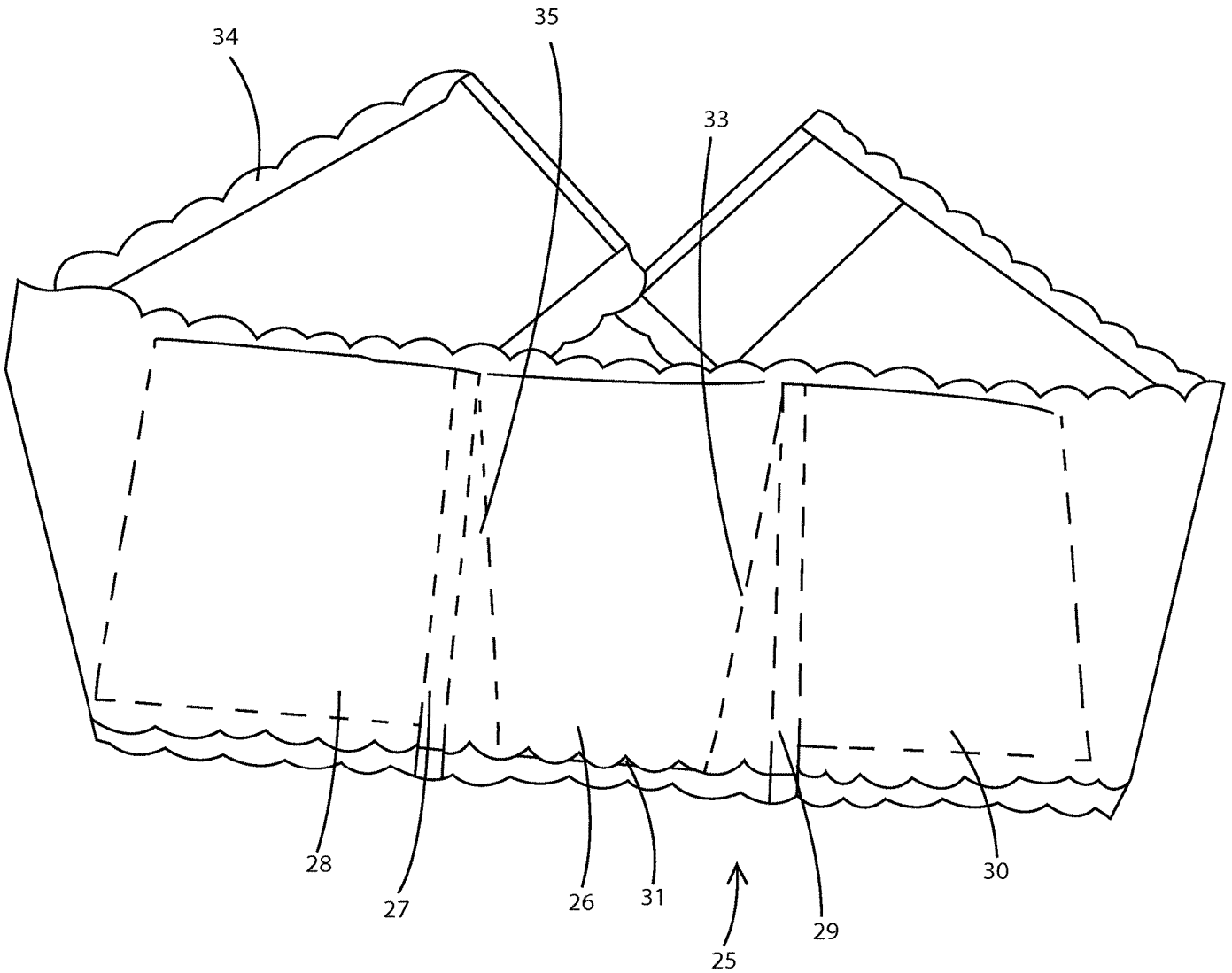
FIG. 2 is a front view of an embodiment of a lace garment having a V-shaped holster pocket supported by boning and two additional pockets supported by boning located to either side of the holster pocket.

FIG. 2 illustrates an embodiment of the invention 25 in which an open ended V-shaped pocket 26 is supported indirectly by boning 27, 29. The material forming the pocket is sewn to the garment at lines 33, 35 proximate to the boning to provide an open ended V-shaped pocket. The muzzle or barrel of a gun protrude out of the pocket via opening 31 in the narrow section of the V-shaped pocket. Additional pockets 28, 30 can also be provided and supported with or without boning. The garment depicted in a preferred embodiment is a girdle or similar under-clothing attire that in the depicted embodiment is made of lace 34.

Figure 3:
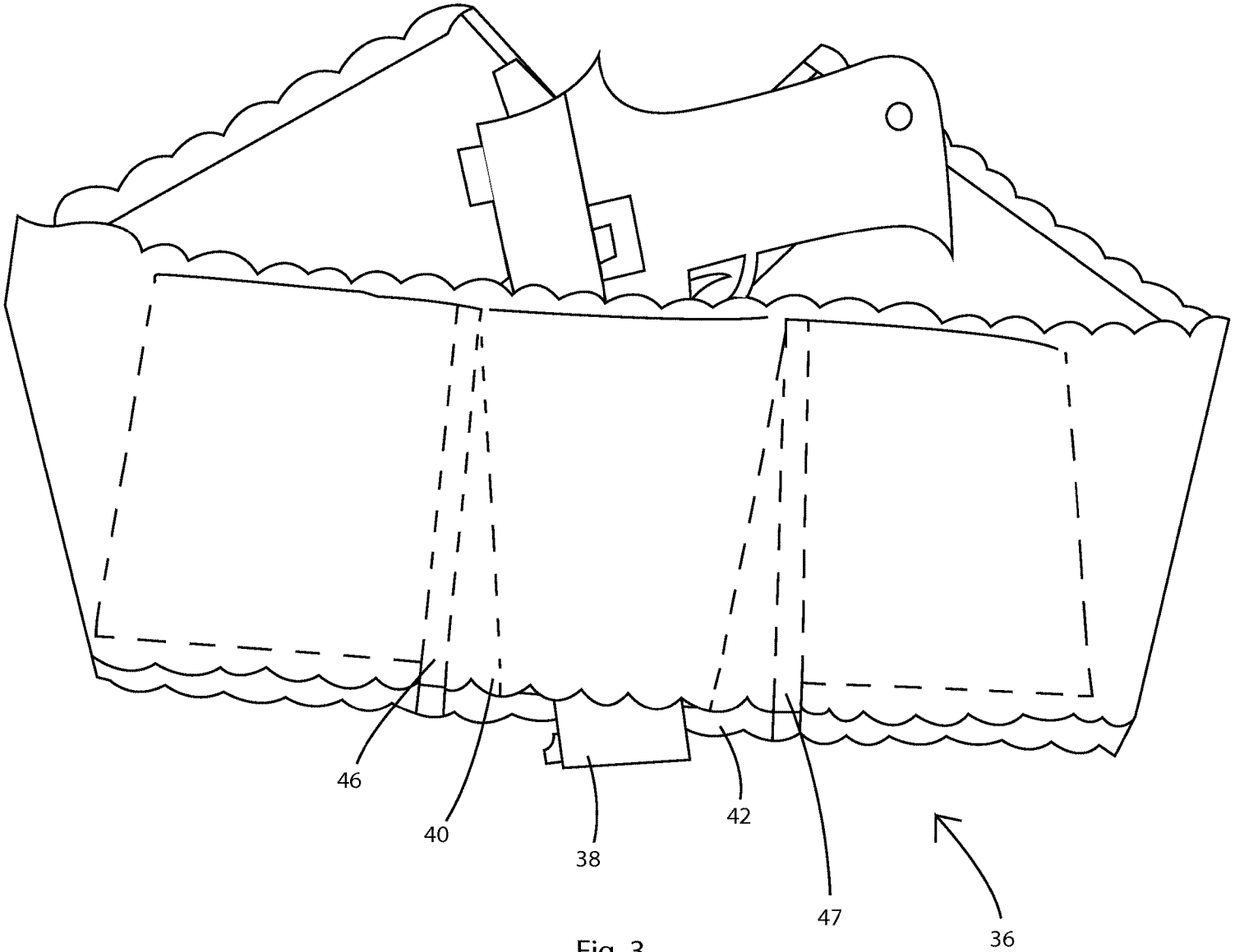
FIG. 3 is a front view of an embodiment of a lace garment having a V-shaped holster pocket supported by boning and having a handgun located within the pocket and with two additional pockets located to either side of the holster pocket.

FIG. 3 illustrates an embodiment of the invention 36 in which a handgun 38 is provide in the V-shaped pocket. The V-shaped pocket is sewn or otherwise attached to the garment at attachment line 40. The V-shaped pocket is supported by proximate boning 46, 47 provides support to weight of the firearm. In a preferred embodiment, the garment is made of lace 42 and constitutes an undergarment.

Figure 4:
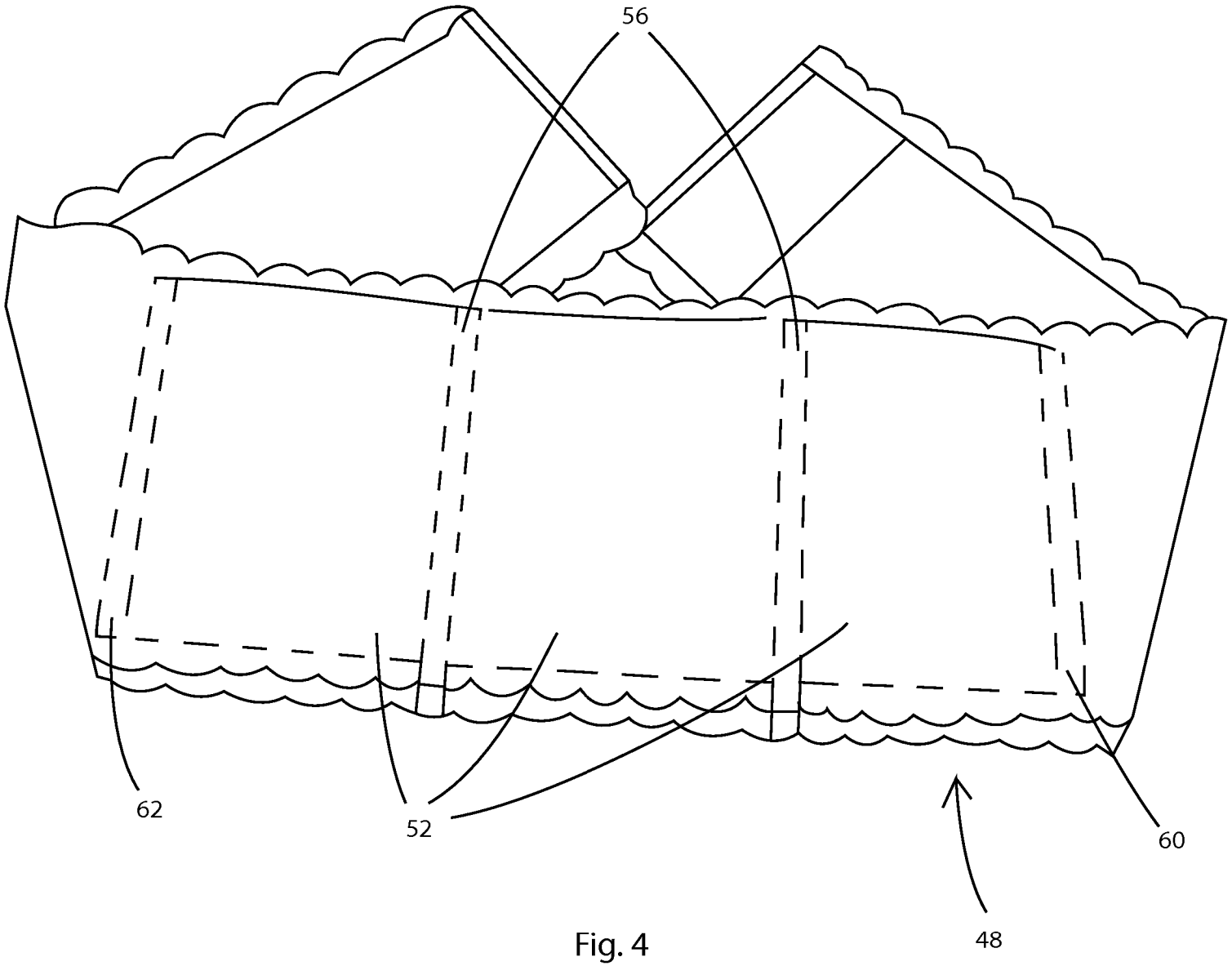
FIG. 4 is a front view of an embodiment of a lace garment having three pockets supported by boning.

FIG. 4 illustrates a further preferred embodiment of the invention 48 in which a plurality of pockets 52 are supported by a plurality of boning 60, 62, 56. The supported pockets provide a mechanism for a user to securely carry items on a user's body in a concealed orientation. The additional support provided by the boning provides additional support to prevent objects being carried from causing the undergarment to sag or move around. The depicted pockets are open on the top and closed on the remaining three sides to allow a user to carry, for example, the user's cell phone, wallet, keys, ammunition magazines or any other object that will fit into the pockets of the undergarment.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

The invention claimed is:

1. A garment having a support pocket, said garment comprising:

a clothing garment;

two lengths of rigid boning affixed to said garment wherein said two lengths of boning comprise a first length of boning and a second length of boning, wherein said first length of boning and said second length of boning are affixed to said garment and comprise a width between said first length of boning and said second length of boning;

a length of material attached to said garment proximate to said first length of boning and extending between said first and said second boning and attached to said garment proximate to said second length of boning, wherein said length of material defines a pocket between said material and said garment.

2. The garment of claim 1, wherein said two lengths of rigid boning are affixed to said garment in a generally parallel orientation.

3. The garment of claim 1, wherein said material comprises an elastic material.

4. The garment of claim 1, wherein said pocket is open ended at two ends.

5. The garment of claim 1, wherein said garment comprises a plurality of pockets.

6. The garment of claim 1, wherein said garment comprises a lace material.

7. The garment of claim 1, wherein said garment comprises a girdle.

8. The garment of claim 1, wherein said garment comprises a belt.

9. The garment of claim 1 wherein said material is attached to said garment at said boning at a first end and a second end of said material, wherein said material is not attached to said boning at either a first side or a second side of said length of material to form an open ended pocket.

10. The garment of claim 9 wherein said material is attached to said garment proximate to said first length of boning and said second length of boning, wherein said length of material is attached to said garment such that said opening is defined as an open ended V-shape.

11. The garment of claim 10, wherein said garment comprises a plurality of lengths of boning, a plurality of lengths of material extending between said lengths of boning, and a plurality of pockets defined by said lengths of material and said garment.

12. The garment of claim 1, wherein said rigid boning comprises a length of rigid nylon.

13. The garment of claim 1, wherein said rigid boning comprises a length of rigid polyester.

14. The garment of claim 1, wherein said pocket comprises an open ended v-shape.

15. The garment of claim 1, wherein said garment comprises a retention mechanism for retaining an object in said pocket.

16. The garment of claim 1, wherein said garment comprises a retention mechanism for retaining an object in said pocket, wherein said retention mechanism comprises a second length of material, wherein said second length of material extends from said garment across said pocket and is attached to said length of material extending between said first length of boning and said second length of boning.

17. The garment of claim 16, wherein said retention mechanism is releasably attached to at least one of said garment and said second length of material.

* * * * *